US007803064B2

(12) United States Patent
Roach et al.

(10) Patent No.: US 7,803,064 B2
(45) **Date of Patent: *Sep. 28, 2010**

(54) GOLF CLUB HEAD WITH MULTIPLE UNDERCUTS

(75) Inventors: Ryan L. Roach, Cardiff-by-the-sea, CA (US); Christopher B. Best, Encinitas, CA (US)

(73) Assignee: Cobra Golf, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/372,040

(22) Filed: Feb. 17, 2009

(65) Prior Publication Data

US 2009/0149272 A1 Jun. 11, 2009

Related U.S. Application Data

(63) Continuation of application No. 11/188,905, filed on Jul. 26, 2005, now Pat. No. 7,507,167, which is a continuation of application No. 10/796,996, filed on Mar. 11, 2004, now Pat. No. 6,962,538.

(51) Int. Cl.
*A63B 53/04* (2006.01)

(52) U.S. Cl. ..... 473/332; 473/350

(58) Field of Classification Search ..... 473/324–350
See application file for complete search history.

(56) References Cited

U.S. PATENT DOCUMENTS 3,955,820 A * 5/1976 Cochran et al. ..... 473/337
4,325,553 A 4/1982 Taylor ..... 473/337
4,326,326 A 4/1982 MacDonald ..... 29/428

(Continued)

FOREIGN PATENT DOCUMENTS

EP 285844 10/1998

(Continued)

OTHER PUBLICATIONS

"Specific Gravity Table for Ceramics, Metals, & Minerals", Read Advanced Materials, copyright 1997.

(Continued)

*Primary Examiner*—Alvin A Hunter
(74) *Attorney, Agent, or Firm*—Knobbe, Martens, Olson & Bear, LLP

(57) ABSTRACT

The present invention relates to a golf club head having multiple undercuts. The club head includes a body defining a striking face, a top line, a sole, and a back, and having a heel and a toe. The back contains a cavity. Multiple undercuts in the form of a plurality of recesses are provided within the cavity. The recesses extend away from the cavity. The recesses may be oriented in a variety of ways. In a first arrangement, the recesses are aligned longitudinally to the striking face in a heel-to-toe direction. In a second arrangement, the recesses are recesses are aligned transverse to the striking face in a front-to-back direction and extend in a heel-to-toe direction. In a third arrangement, the plurality of recesses includes both longitudinally arranged and transversely arranged recesses. An insert, such as a weight insert, a dampening insert, or a combination insert, is preferably positioned within each of the recesses.

13 Claims, 3 Drawing Sheets

U.S. PATENT DOCUMENTS

| | | | | | |
|---|---|---|---|---|---|
| 4,340,230 | A * | 7/1982 | Churchward | 473/339 |
| 4,869,507 | A * | 9/1989 | Sahm | 473/337 |
| 5,385,348 | A * | 1/1995 | Wargo | 473/338 |
| 5,944,619 | A | 8/1999 | Cameron | 473/332 |
| 6,077,171 | A * | 6/2000 | Yoneyama | 473/291 |
| 6,290,609 | B1 * | 9/2001 | Takeda | 473/335 |
| 6,592,468 | B2 | 7/2003 | Vincent et al. | 473/334 |
| 6,616,547 | B2 | 9/2003 | Vincent et al. | 473/334 |
| 6,648,772 | B2 * | 11/2003 | Vincent et al. | 473/334 |
| 6,811,496 | B2 * | 11/2004 | Wahl et al. | 473/334 |
| 6,962,538 | B2 * | 11/2005 | Roach et al. | 473/332 |
| 7,037,213 | B2 * | 5/2006 | Otoguro | 473/333 |
| 7,048,647 | B2 * | 5/2006 | Burrows | 473/334 |
| 7,077,763 | B2 * | 7/2006 | Wahl et al. | 473/334 |
| 7,083,530 | B2 * | 8/2006 | Wahl et al. | 473/334 |
| 7,238,119 | B2 * | 7/2007 | Roach et al. | 473/350 |
| 7,273,418 | B2 * | 9/2007 | Gilbert et al. | 473/290 |
| 7,371,190 | B2 * | 5/2008 | Gilbert et al. | 473/332 |
| 7,455,600 | B2 * | 11/2008 | Imamoto et al. | 473/345 |
| 7,507,167 | B2 * | 3/2009 | Roach et al. | 473/335 |

FOREIGN PATENT DOCUMENTS

| | | |
|---|---|---|
| GB | 2251556 | 7/1992 |
| GB | 2308071 | 6/1997 |
| JP | U-S59-190268 | 12/1984 |
| JP | 10277186 A * | 10/1998 |
| JP | A-H10-277186 | 10/1998 |
| JP | A-H11-24430 | 10/1998 |
| JP | A-H10-295861 | 11/1998 |
| JP | 11070193 | 3/1999 |
| JP | 11244430 A * | 9/1999 |
| JP | A-2000-296192 | 10/2000 |
| JP | 2001-000606 | 1/2001 |
| JP | 2002-143356 | 5/2002 |
| WO | WO98/32500 | 7/1998 |
| WO | WO03/084617 | 10/2003 |

OTHER PUBLICATIONS

"Silicone", Efunda Engineering Fundamentals. www.efunda.com.

Non-Final Office Action dated Dec. 26, 2007 of corresponding U.S. Appl. No. 11/188,905.

Final Office Action dated Apr. 25, 2008 of corresponding U.S. Appl. No. 11/188,905.

Advisory Action dated Jul. 11, 2008 of corresponding U.S. Appl. No. 11/188,905.

Notice of Allowance dated Nov. 6, 2008 of corresponding U.S. Appl. No. 11/188,905.

Non-Final Office Action dated Jul. 14, 2004 of corresponding U.S. Appl. No. 10/796,996.

Final Office Action dated Jan. 31, 2005 of corresponding U.S. Appl. No. 10/796,996.

Reexamination Report in corresponding Japanese Application No. 2005-67622.

* cited by examiner

GOLF CLUB HEAD WITH MULTIPLE UNDERCUTS

CROSS-REFERENCE TO RELATED APPLICATIONS

This application is a continuation of U.S. patent application Ser. No. 11/188,905 filed on Jul. 26, 2005, now U.S. Pat. No. 7,507,167, which is a continuation of U.S. patent Ser. No. 10/796,996 filed on Mar. 11, 2004, now U.S. Pat. No. 6,962, 538, the entireties of which are incorporated herein by reference in their entirety.

BACKGROUND OF THE INVENTION

1. Field of the Invention

The present invention relates to a golf club head, and, more particularly, to a golf club head having multiple undercuts.

2. Description of the Related Art

Iron-type golf clubs generally include a front or striking face, a top line, and a sole. The front face interfaces with and strikes the golf ball. A plurality of score lines or grooves is positioned on the face to assist in imparting spin to the ball. The top line is generally configured to have a particular look to the golfer and to provide weight. The sole of the golf club is particularly important to the golf shot because it contacts and interacts with the ground during the golf shot.

In conventional sets of iron-type golf clubs, each club includes a shaft with a club head attached to one end and a grip attached to the other end. The club head includes a face for striking a golf ball. The angle between the face and a vertical plane is called the loft angle.

The set generally includes irons that are designated number 2 through number 9, and a pitching wedge. Other wedges, such as a lob wedge, a gap wedge, and a sand wedge, may be optionally included with the set. Each iron has a shaft length that usually decreases through the set as the loft for each club head increases from the long irons to the short irons. The length of the club, along with the club head loft and center of gravity location, impart various performance characteristics to the ball's launch conditions upon impact and determine the distance the ball will travel. Flight distance generally increases with a decrease in loft angle. However, difficulty of use also increases with a decrease in loft angle.

Iron-type golf clubs generally can be divided into three categories: blades, muscle backs, and cavity backs. Blades are traditional clubs with a substantially uniform appearance from the sole to the top line, although there may be some tapering from sole to top line.

Muscle backs have a substantially traditional appearance and are similar to blades, but have extra material on the back. This extra material, which may be in the form of a rib, can be used to lower the club head center of gravity. Having the club head center of gravity lower than the ball center of gravity at contact increases the launch angle of the resulting golf shot.

Since blade and muscle back designs have a small sweet spot (that is, the area of the face that results in a desirable golf shot upon striking a golf ball), they are relatively difficult to use and are therefore typically only used by skilled golfers. However, since these designs are less forgiving than cavity backs, they allow a skilled golfer to work the ball and shape the golf shot as desired.

Cavity backs are modern designs that move some of the club mass to the perimeter of the club by providing a hollow or cavity in the back of the club, opposite the striking face. This produces a more forgiving club with a larger sweet spot. This also allows the size of the club face to be increased, also resulting in a larger sweet spot. The perimeter weighting created by the cavity also increases the club's moment of inertia, which is a measurement of the club's resistance to torque, for example the torque resulting from an off-center hit. Because of the increased moment of inertia, these clubs are easier to hit than blades and muscle backs, and are therefore usable by less-skilled and beginner golfers.

Other known golf clubs achieve a desired balance or moment of inertia by adding a weight to the club. These clubs typically add a weight member to the bottom surface of the sole, in the center thereof.

SUMMARY OF THE INVENTION

The present invention relates to a golf club head having multiple undercuts. The club head includes a body defining a striking face, a top line, a sole, and a back, and having a heel and a toe. The back contains a cavity. A plurality of recesses is provided within the cavity, with the recesses extending away from the cavity. The golf club head preferably is an iron-type golf club head.

The recesses may be oriented in a variety of ways. In a first arrangement, the recesses are aligned longitudinally to the striking face in a heel-to-toe direction. That is, a line can be drawn in the heel-to-toe direction that intersects each of the recesses. In a second arrangement, the recesses are aligned transverse to the striking face in a front-to-back direction and extend in a heel-to-toe direction. That is, a line can be drawn in the front-to-back direction that intersects each of the recesses. In a third arrangement, the plurality of recesses includes both longitudinally arranged and transversely arranged recesses.

The longitudinally arranged recesses preferably include a first recess positioned in a heel portion of the cavity and a second recess positioned in a toe portion of the cavity. A third recess may be provided intermediate the first and second recesses. The first and second recesses each have a volume from approximately 1 cubic centimeter to approximately 10 cubic centimeters, and have a depth of approximately 0.300 inch to approximately 0.800 inch. The third recess has a volume greater than each of the first and second recesses. Alternatively, the third recess volume is greater than the combined volumes of the first and second recesses, and optionally it is greater than twice the combined volumes of the first and second recesses. The third recess has a depth of approximately 0.450 inch to approximately 0.700 inch.

The transversely arranged recesses preferably include a first recess positioned adjacent the back and a second recess positioned adjacent the first recess.

An insert is preferably positioned within each of the recesses. Preferred inserts include weight members and dampening members. The types of inserts positioned within any specific recess are varied, resulting in numerous permutations of club head designs. The specific design chosen depends upon the golfer's swing and the desired characteristics of the club. For the longitudinally arranged recesses, the weight inserts preferably have a mass greater than or equal to approximately 10 grams. For the transversely arranged recesses, the weight inserts have a mass of approximately 10 to approximately 20 grams. The weight members may also have a mass less than 10 grams. For example, if a third weight member is included, it is contemplated that it will have a mass less than 10 grams. In relative terms, the weight members have a specific gravity greater than a specific gravity of the club head. If more than one weight member is included, the weight members may or may not be substantially identical. The dampening members preferably have a mass less than 10 grams and a specific gravity less than the club head specific gravity. The recesses may also include a plurality of inserts. For example, any specific recess may include both a weight member and a dampening member positioned therein.

DESCRIPTION OF THE DRAWINGS

The present invention is described with reference to the accompanying drawings, in which like reference characters reference like elements, and wherein.

DETAILED DESCRIPTION OF THE INVENTION

Figure 1:
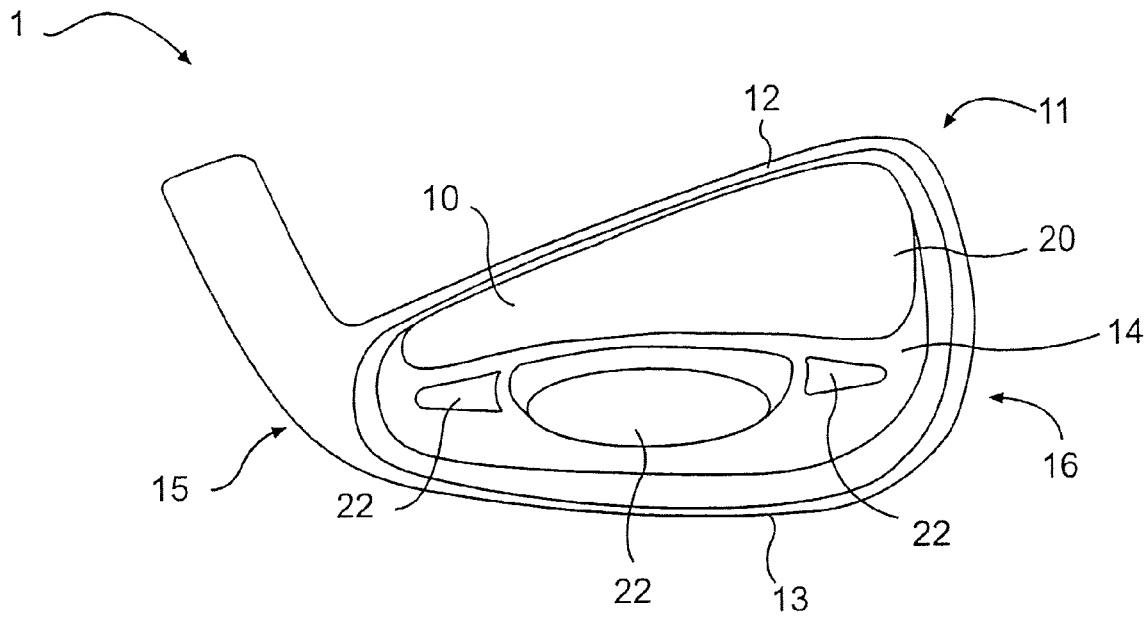
FIG. 1 shows a rear view of a first golf club head of the present invention.

FIG. 1 shows a rear view of a first golf club head 1 of the present invention. The club head 1 includes a body 10 defining a striking face 11, a top line 12, a sole 13, and a back 14. The club head 1 also has a heel 15 and a toe 16. The back 14 includes a cavity 20, and the cavity 20 contains multiple undercuts in the form of a plurality of recesses 22 extending away from the cavity 20. Preferably, the club head 1 is an iron-type golf club head.

The recesses 22 are provided in the club body 10 and extend toward the sole 13. This advantageously allows materials to be added to the club head 1 without penetrating the sole 13. In known club heads that include, for example, weight inserts, the weights are typically added through the sole. However, since weights are often softer than the club head body, and since the sole of the club strikes the ground during normal use of the golf club, the weights will likely become dinged or worn, resulting in an unsightly appearance. The recesses 22 of the present invention, however, allow the addition of weights or other members to the club head while isolating them from the sole 13. This prevents them from contacting the ground during the golf swing, and helps preserve the like-new appearance of the club.

By providing a plurality of recesses 22, the present invention allows a plurality of inserts to be added to the golf club independently. Each of the recesses 22 can accept an insert independently of the other recesses 22. Identical inserts can be placed within each of the recesses 22, or each of the recesses 22 can house a unique member. In this manner, the golf club can be tailored to a golfer's unique swing characteristics. Preferably, the inserts completely fill the recesses 22.

Figure 2:
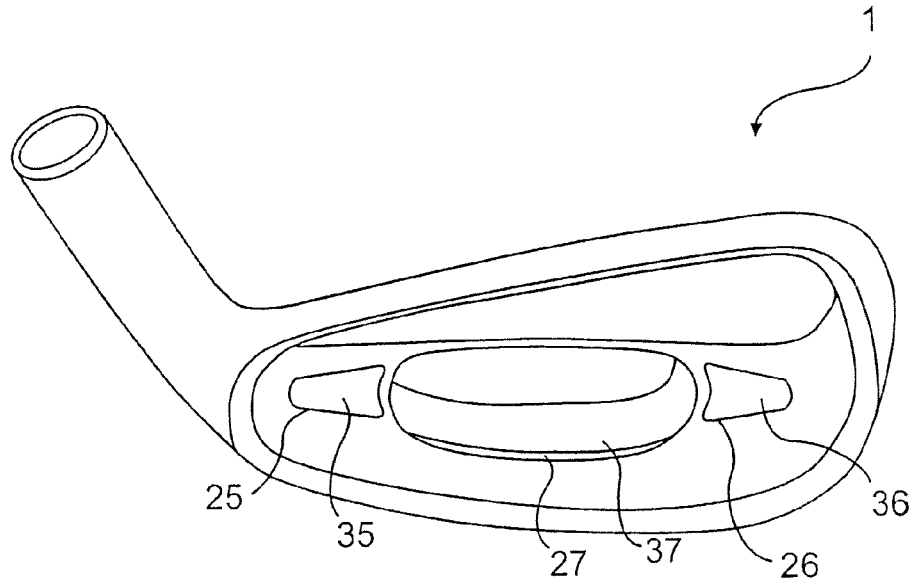
FIG. 2 shows another view of the golf club head of FIG. 1.

FIG. 2 shows another view of the golf club head 1 of FIG. 1. In the illustrated embodiment, the recesses 22 are aligned substantially longitudinally to the striking face 11 in a heel-to-toe direction. The golf club head 1 includes a first recess 25 positioned in a heel portion of the cavity 20 and a second recess 26 positioned in a toe portion of the cavity 20. Each of the recesses 25, 26 preferably has a volume from approximately 1 cubic centimeter to approximately 10 cubic centimeters. Each of the recesses 25, 26 preferably has a depth of approximately 0.300 inch to approximately 0.800 inch, and more preferably approximately 0.450 inch to approximately 0.700 inch. These dimensions allow an insert, such as a weight member, of appropriate size and mass to be added to each of the recesses 25, 26. Note that due to the contours of the club head 1, the depths of the recesses will vary depending on the location at which the measurement is taken.

FIG. 2 shows a first insert 35 positioned within the first recess 25 and a second insert 36 positioned within the second recess 26. The inserts 35, 36 may be weight members. Each of the recesses 25, 26 may include a weight member 35, 36, or only one of the recesses 25, 26 may include a weight member 35, 36. Alternatively, neither the recesses 25, 26 includes a weight member 35, 36. If weight members 35, 36 are present, each such weight member 35, 36 preferably has a mass from approximately 5 g to approximately 30 g, and more preferably greater than or equal to approximately 10 grams. The weight members 35, 36 may also be described in terms relative the club head 1. Each weight member 35, 36 preferably may have a specific gravity greater than a specific gravity of the club head. The weight members 35, 36 may be substantially identical, or they may be different. The first weight member 35 may have a specific gravity that is less than the specific gravity of the second weight member 36. This may be desired for a golfer that tends to slice the ball, since biasing the club head center of gravity toward the heel 15 makes it easier to close, decreasing the likelihood of leaving the club head open at impact. Alternatively, the first weight member 35 may have a specific gravity that is greater than the specific gravity of the second weight member 36. This may be desired for a golfer that tends to hook the ball, since biasing the club head center of gravity toward the toe 16 makes it harder to close, decreasing the likelihood of closing the club head too soon or too much at impact. Preferably, weight members are included in each of the recesses 25, 26, moving more of the club head mass to the perimeter, producing a greater moment of inertia (MOI) and increasing the size of the club head sweet spot. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, increasing the club head resistance to twisting due to off-center hits, making the club more forgiving.

In lieu of weight members, one or both of the inserts 35, 36 may be dampeners. Preferred dampening materials, which diminish vibrations in the club head, including vibrations generated during an off-center hit, include one or more of rubber, urethane, polyurethane, butadiene, polybutadiene, and silicone. The insert may completely fill the recess, or may fill only a portion thereof.

The illustrated embodiment of golf club head 1 further includes a third recess 27 intermediate the first and second recesses 25, 26. The third recess 27 allows a third insert to be added to the club head 1 independently of the previously discussed inserts. The third recess 27 preferably has a volume greater than each of the first and second recesses 25, 26. The volume of the third recess 27 preferably may be greater than the combined volumes of the first and second recesses 25, 26, or it preferably may be greater than twice the combined volumes of the first and second recesses 25, 26. The third recess 27 preferably has a depth of approximately 0.450 inch to approximately 0.700 inch, and more preferably approximately 0.250 inch to approximately 0.500 inch. These dimensions allow a member of appropriate size and mass to be added to the center of the club head 1.

A third insert 37 may be positioned within the third recess 27. The third insert 37 may be a weight member. If a weight member, it preferably has a mass less than approximately 10 grams. In relative terms, the third weight member 37 preferably has a specific gravity less than the club head specific gravity. The specific gravity of the third weight member 37 may be less than each of the specific gravities of the first and second weight members 35, 36. Alternatively, the specific gravity of the third weight member 37 may be greater than each of the specific gravities of the first and second weight members 35, 36. Alternatively, the specific gravity of the third weight member 37 may be intermediate the specific gravities of the first and second weight members 35, 36.

Instead of being a weight member, the insert 37 may be something else, such as a dampening member. Use of a dampening member is useful to diminish vibrations in the club head 1, such as those generated during an off-center hit. A dampening member 37 may be used alone or in conjunction with other inserts 35, 36, such as weight members. The dampening member 37 preferably has a mass less than the masses of each of the weight members 35, 36. In relative terms, the dampening member 37 has a specific gravity less than the specific gravity of the club head 1.

Figure 3:
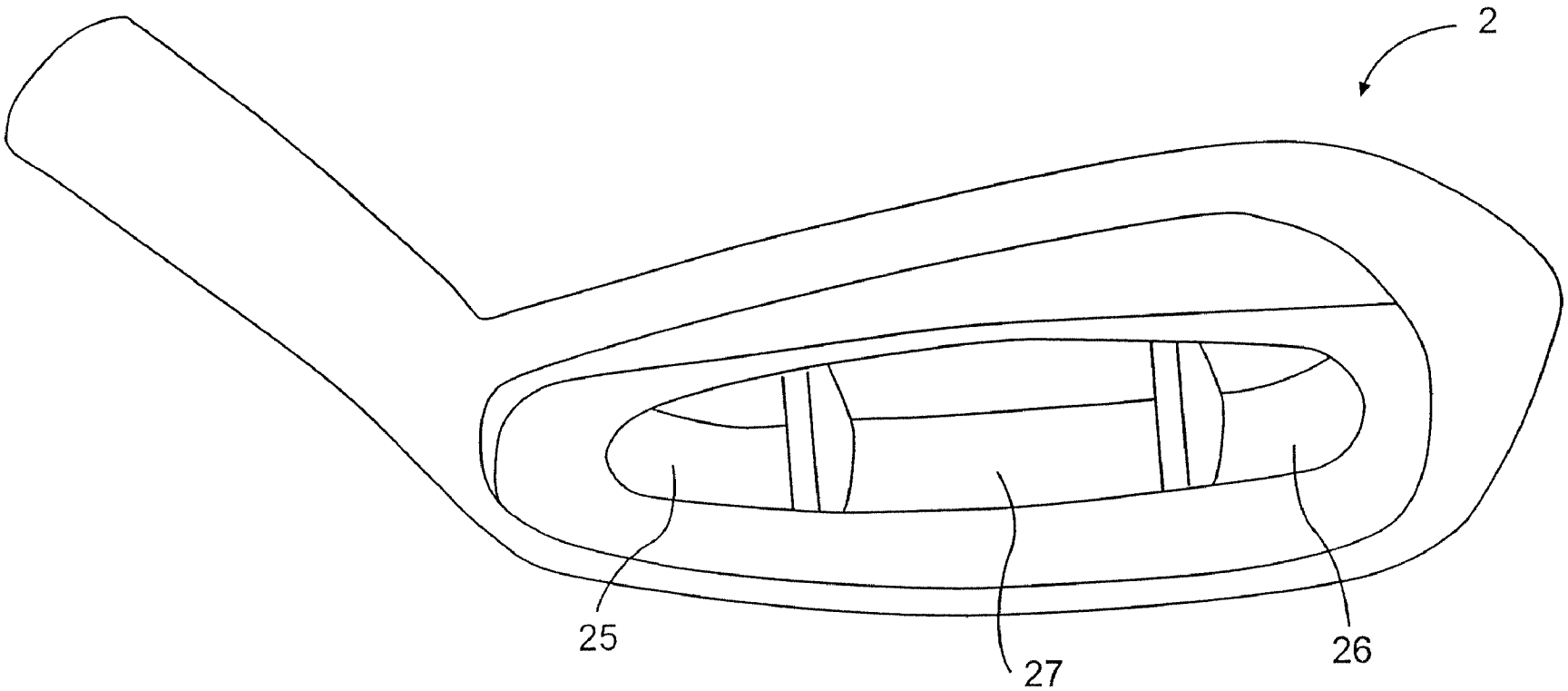
FIG. 3 shows a rear view of a second golf club head of the present invention.

FIG. 3 shows a rear view of a second golf club head 2 of the present invention. Like the first club head 1, the second club head 2 includes a plurality of recesses. The illustrated embodiment contains a toe recess 26, a central recess 27, and a heel recess 25 similar to the first club head 1. The shapes and volumes of the recesses, however, are different than in the first club head 1.

Figure 4:
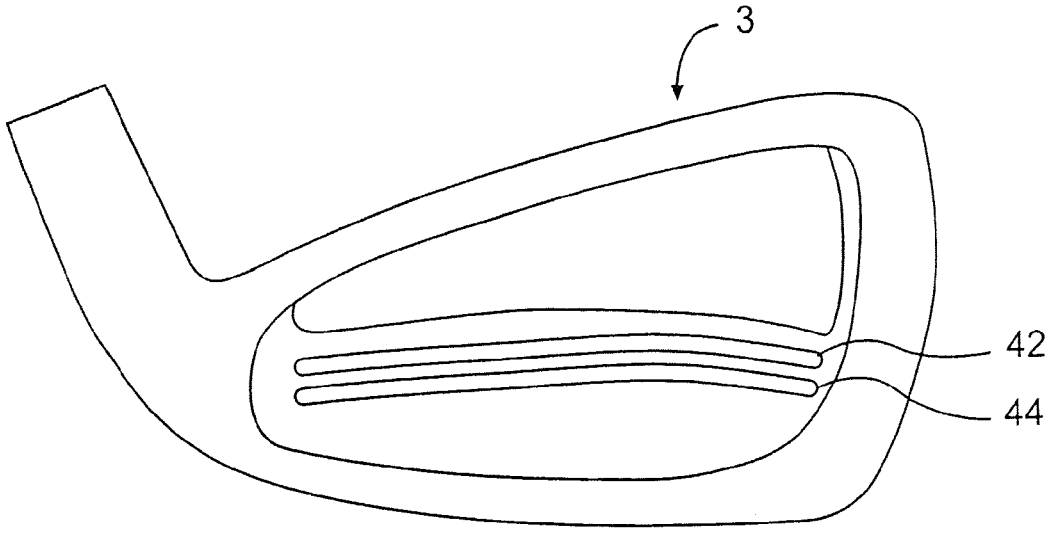
FIG. 4 shows a rear view of a third golf club head of the present invention.

FIG. 4 shows a rear view of a third golf club head 3 of the present invention. Similarly to the previously discussed club heads, this club head 3 includes a body defining a striking face, a top line, a sole, a back, a heel, and a toe. The back includes a cavity, and the cavity contains multiple undercuts in the form of a plurality of recesses extending away from the cavity. The recesses are provided in the club body and extend toward the sole.

The recesses of the third club head 3 are aligned substantially transverse to the striking face in a front-to-back direction and extend in a heel-to-toe direction. The plurality of recesses includes a first recess 42 positioned adjacent the back. Preferably, the first recess 42 has a volume of approximately 1 cubic centimeter to approximately 10 cubic centimeters. A second recess 44 may also be provided in the back of the club head adjacent the first recess 42. The second recess 44 also preferably has a volume of approximately 1 cubic centimeter to approximately 10 cubic centimeters. Due to the contours of the club head 3, it is likely that the volume of the second recess 44 is less than the volume of the first recess 42.

Inserts may be provided within either or both of the recesses 42, 44. Contemplated inserts include weights and vibration dampeners. For example, a weight member may be positioned within the first recess 42, and a dampening member may be positioned within the second recess 44. Alternatively, a dampening member may be positioned within the first recess 42, and a weight member may be positioned within the second recess 44, which will move the center of gravity toward the rear of the club head 3, increasing the MOI and making the club more forgiving. Alternatively, both recesses 42, 44 may contain the same type of insert. The positioning of the weight and/or dampening members within the recesses 42, 44 and the masses of such members will affect the feel and playability of the golf club. Any weight members preferably have a specific gravity greater than a specific gravity of the club head, and any dampening members preferably have a specific gravity less than the club head specific gravity. It is contemplated that the weight member has a mass of approximately 10 to approximately 20 grams.

Figure 5:
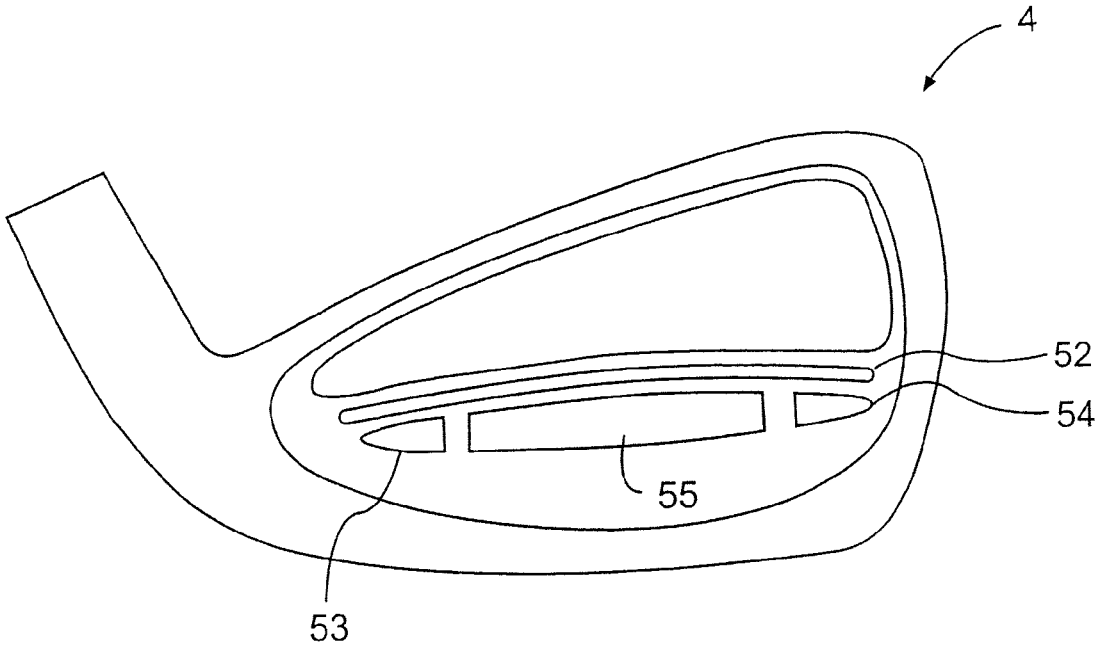
FIG. 5 shows a rear view of a fourth golf club head of the present invention.

FIG. 5 shows a rear view of a fourth golf club head 4 of the present invention. The club head 4 includes a body defining a striking face, a top line, a sole, a back, a heel, and a toe. The back includes a cavity, and the cavity contains multiple undercuts in the form of a plurality of recesses extending away from the cavity. The recesses are provided in the club body and extend toward the sole.

The recesses of the club head 4 include both types of recesses discussed above. A first recess 52 is aligned substantially transverse to the striking face, and extends in a heel-to-toe direction. A second recess 53 is aligned substantially longitudinally to the striking face, and is positioned in a heel portion of the cavity. A third recess 54 is aligned substantially longitudinally to the striking face, and is positioned in a toe portion of the cavity. The second and third recesses 53, 54 are aligned in a heel-to-toe direction. A fourth recess 55 may be provided intermediate the second and third recesses 53, 54. Any desired combination of weight members and dampening members may be provided with the recesses 52, 53, 54, 55. In a preferred embodiment, a dampening member is provided within the first recess 52, and weight members are provided within the second and third recesses 52, 54. Either a weight member or a dampening member may be provided within the fourth recess 55.

In each of the above-described golf club heads, the recesses can contain a plurality of inserts or a hybrid insert. For example, a weight member can be inserted into the lower part of any of the recesses, and a dampening member can be inserted atop the weight member. This may advantageously allow for enhancement of MOI and sweet spot size, while simultaneously providing for vibration dampening.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A golf club head, comprising:

a body defining a striking face, a top line, a sole, and a back, and having a heel and a toe, wherein:

the back contains a cavity therein extending toward the face; and the back includes a plurality of recesses therein, each of the recesses extending from the cavity towards the sole;

wherein the plurality of recesses includes a first, second, and third recess;

wherein each of the first, second and third recesses have a volume;

and the volume of the third recess is greater than the volume of the first and second recess;

wherein the third recess is located intermediate the first and second recess;

at least one of the plurality of recesses includes a dampening member and at least one of the plurality of recesses includes a weight member;

a fourth recess extends toward the sole and is aligned substantially transverse to the striking face; and a fourth insert is located within the fourth recess.

2. The golf club head of claim 1, wherein the first and second recess include dampening members and the third recess includes a weight member.

3. The golf club head of claim 1, wherein at least one of the plurality of recesses includes a hybrid insert.

4. The golf club head of claim 1, wherein the dampening member has a specific gravity less than a specific gravity of the club head.

5. The golf club head of claim 1, wherein the weight member has a specific gravity greater than a specific gravity of the club head.

6. The golf club head of claim 1, wherein at least one of the plurality of recesses include two inserts.

7. The golf club head of claim 1, wherein the first recess includes a weight member, the second insert includes a dampening member, and the third recess includes a hybrid insert.

8. The golf club head of claim 1, wherein the first and second recess include weight members and the third recess includes a dampening member.

9. A golf club head, comprising:

a body defining a striking face, a top line, a sole, and a back, and having a heel and a toe, wherein:

the back contains a cavity therein extending toward the face;

the back includes first, second, and third recesses therein, each of the first, second, and third recesses aligned substantially longitudinally to the striking face;

the third recess is located intermediate the first and second recess;

the first recess and the third recess include different inserts;

wherein each of the first, second and third recesses have a volume;

the volume of the third recess is greater than the volume of the first and second recess combined;

a fourth recess extends toward the sole and is aligned substantially transverse to the striking face; and a fourth insert is located within the fourth recess.

10. The golf club head of claim 9, wherein the first and second recesses include inserts that have a specific gravity less than a specific gravity of the club head.

11. The golf club head of claim 9, wherein the third recess includes an insert that has a specific gravity higher than a specific gravity of the club head.

12. The golf club head of claim 9, wherein at least one of the first, second, and third recesses include a plurality of inserts.

13. The golf club head of claim 9, wherein at least one of the first, second, or third recesses include a hybrid insert.

* * * * *